US005085710A

United States Patent [19]

Goss

[11] Patent Number: 5,085,710

[45] Date of Patent: Feb. 4, 1992

[54] METHOD OF USING AN AQUEOUS CHEMICAL SYSTEM TO RECOVER HYDROCARBON AND MINIMIZE WASTES FROM SLUDGE DEPOSITS IN OIL STORAGE TANKS

[75] Inventor: Michael L. Goss, Houston, Tex.

[73] Assignee: Nalco Chemical Company, Naperville, Ill.

[21] Appl. No.: 429,360

[22] Filed: Oct. 31, 1989

[51] Int. Cl.[5] ..... B08B 9/08

[52] U.S. Cl. ..... 134/22.14; 134/22.19; 134/40; 252/170; 252/173; 252/174.21; 252/174.22; 252/DIG. 1

[58] Field of Search ..... 134/22.14, 22.19, 40; 252/170, 173, 174.21, 174.22, DIG. 1

[56] References Cited

U.S. PATENT DOCUMENTS 3,436,263 1/1969 Strenkert et al. ..... 134/22.19
4,233,174 11/1980 Sheridan ..... 134/40

FOREIGN PATENT DOCUMENTS 1771531 12/1971 Fed. Rep. of Germany .
2318109 11/1973 Fed. Rep. of Germany .
52-155873 12/1977 Japan .
1361557 7/1974 United Kingdom .
1385122 2/1975 United Kingdom .
1553212 9/1979 United Kingdom .

OTHER PUBLICATIONS

Barnett, Better Ways to Clean Crude Storage Tanks and Desaltens, Hydrocarbon Processing, pp. 82–86 (1980).

Yoshimura, T. et al., A New Chemical Cleaning Method for Sludge Produced in Oil Storage Tanks, Eiron. Eng. Technol. Dep. Shin Nikka Co. Ltd., vol. 24(2), pp. 58–63 (Japan 1980) (Search Answer No. 54).

Barnett, Better Ways to Clean Crude Storage Tanks and Desalters, 60 Hydrocarbon Processing, pp. 82–86 (United States 1980).

Broad, F. W., Studies in Cleaning Techniques, Chemistry Industry, No. 48, pp. 1371–1375 (London 1971).

Inventors Literature Search Report (Search No. 2965 8/17/89).

*Primary Examiner*—Theodore Morris
*Assistant Examiner*—Zeinab El-Arini
*Attorney, Agent, or Firm*—Arnold, White & Durkee

[57] ABSTRACT

Sludge deposited in a crude oil storage tank is treated with a warm-water based nonionic surfactant to minimize waste and recover hydrocarbon. The process entails draining oil from the storage tank, adding water with a nonionic surfactant, and adding diluent to recover hydrocarbon. The tank contents are heated to 145° F. to 180° F. When no sludge remains on the tank bottom, the diluent layer containing the recovered hydrocarbon can be drained directly into the crude unit, without upsets, and the aqueous layer into the API unit.

15 Claims, 1 Drawing Sheet

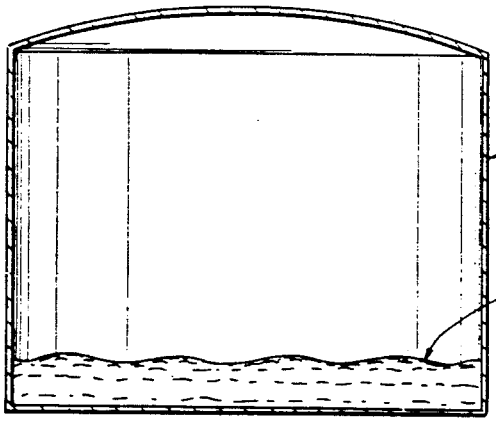
FIG. 1
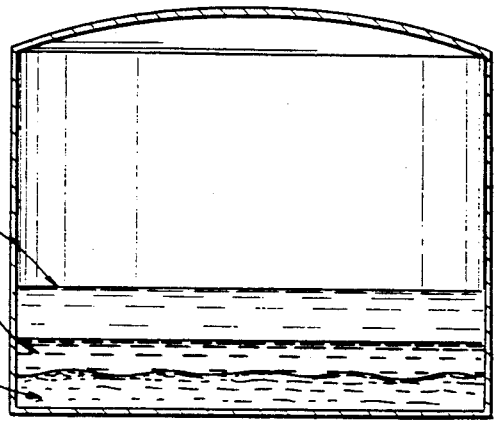
FIG. 2
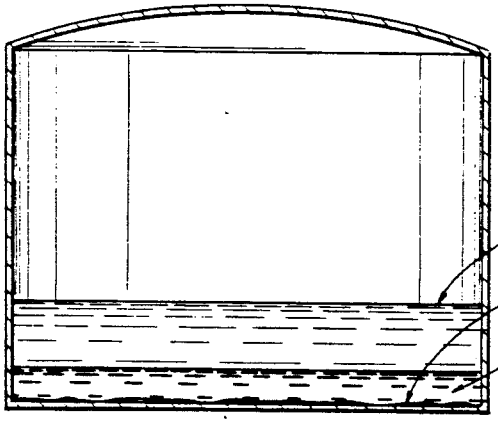
FIG. 4
FIG. 3
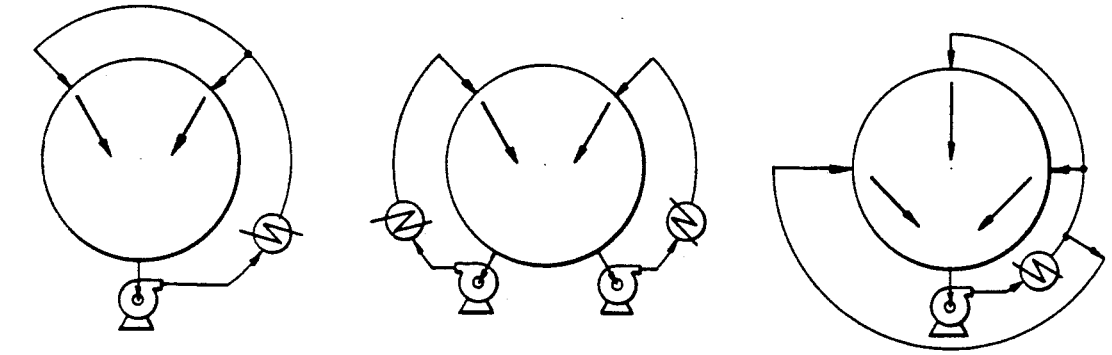

METHOD OF USING AN AQUEOUS CHEMICAL SYSTEM TO RECOVER HYDROCARBON AND MINIMIZE WASTES FROM SLUDGE DEPOSITS IN OIL STORAGE TANKS

BACKGROUND OF THE INVENTION

This invention relates to a method of chemically cleaning sludge deposits from oil storage tanks by separating sludge into its hydrocarbon, aqueous and solid-matter components. Typically, sludge in a crude oil storage tank is composed of 40%-95% recoverable hydrocarbons. This invention is an economically and environmentally sound way to recover processable hydrocarbons as well as to remove sludge. Consequently, it minimizes wastes.

The present invention is an advancement over prior chemical cleaning methods which used oil based systems with dispersants. In said methods the sludge was typically sent to a crude unit. Sending the sludge to the crude unit passes high BS&W material through the desalters. As a result crude unit upsets often occur. The present invention does not send sludge components likely to cause crude unit upsets. Instead, via an aqueous chemical system, this invention sends only clean oil directly to the crude unit. The recovered hydrocarbon's value often exceeds tank cleaning costs.

Tanks are cleaned to repair leaks in the floor, steam coils, and roof drains. They are cleaned to facilitate removal or repair of sunken roofs. Tanks are also cleaned to recover storage capacity, and eliminate crude unit upsets. Crude unit upsets are caused by pluggage of the suction line to the crude charge pumps, slugs of water due to pluggage of the tank water draw, or slugs of solids because of high sludge levels in the tank. Additionally, cleaned tanks can be inspected and maintained to prevent their causing environmental harm.

Currently, federal environmental laws regulating waste disposal provide incentive for efficient chemical methods for cleaning storage tanks. Many standard tank cleaning methods, however, are too ineffective in minimizing waste to accord with federal laws. These methods include manual removal of sludge by workers inside the tank; mechanical removal by a front-end loader, which necessitates cutting a hole into the tank's side for entry; removal by remote control dredging devices; removal by power spray nozzles; and removal by circulating hot oil through the tank. Moreover, none of these methods in themselves recovers clean hydrocarbon; the sludge, after it is removed, must be taken elsewhere for hydrocarbon recovery.

Furthermore, hot oil methods and mechanical high shear methods form emulsions when water is circulated with the sludge. Emulsions would also likely occur if other standard surfactants, such as sulfonates, or sulfonate salts, were used. Emulsions make recovery of clean hydrocarbon more formidable. The present invention does not form emulsions.

In summary, the invention's main benefits are: (1) It recovers processable hydrocarbon, which is directly sent to the crude unit; (2) It minimizes waste by releasing water, which is routinely processable by the Waste Water Treatment Plant; and (3) It is emulsion free. Thus, the invention leaves only oil free solids to be landfarmed.

Other notable benefits include reduced tank downtime and reduced maintenance costs. By reducing crude tank downtime, the invention increases available crude storage capacity. This can have a major impact on refinery operations. By reducing manpower requirements, the invention generally lowers maintenance costs.

SUMMARY OF THE INVENTION

The invention requires draining the oil storage tank as low as possible, leaving mainly sludge deposits in the tank. An aqueous solution with the nonionic surfactant (hereinafter "cleaning solution") is added to the tank, followed by the diluent. The nonionic surfactant in the water performs two functions: It penetrates the sludge to clean metal surfaces, and it strips oil off the solids in the sludge so the solids remain on the bottom. The diluent accepts the cleaned hydrocarbon, solubilizes and disperses it into a stable solution. The aqueous and diluent layers can then be drawn from the tank without concern of forming emulsions.

BRIEF DESCRIPTION OF THE DRAWINGS

FIG. 1 illustrates a crude storage tank pumped to its lowest level, with sludge deposited on the tank bottom.

FIG. 2 illustrates the relative arrangement of sludge, cleaning solution, and diluent after adding cleaning solution and diluent to the tank.

FIG. 3 illustrates three possible tank heat and circulation arrangements; this illustration is not intended to limit the scope of any claims.

FIG. 4 illustrates the arrangement of the solid, aqueous, and diluent layers after treatment with the cleaning solution.

DETAILED DESCRIPTION OF THE INVENTION

The cleaning procedure under the invention is as follows:

1. Pump the crude tank down to its lowest level possible (FIG. 1).

2. Add cleaning solution to the oil storage tank to cover the sludge. The nonionic surfactant in the cleaning solution is a combination of different $C_8$–$C_{12}$ alkylphenol-ethylene oxide adducts and at least one castor oil-ethylene oxide adduct. Additionally, some or all of the castor oil adduct may be replaced by $C_8$–$C_{12}$ aliphatic ethylene oxide adducts. Suitable aliphatic ethylene oxide acceptors include naturally occurring fatty acids, alcohols and amines. Synthetic alcohols and acids are also suitable. The preferred adducts are prepared from nonylphenol and castor oil.

The molar percentage of ethylene oxide in the adducts ranges from 55%–75%. The weight percentage of each adduct component ranges from 10%–40%. The most preferred nonionic surfactant in the cleaning solution comprises: (1) 25% by weight of a nonylphenol-ethylene oxide adduct of about 68% by weight ethylene oxide; (2) 25% by weight of a nonylphenol-ethylene oxide adduct of about 60% by weight ethylene oxide; (3) 25% by weight of a nonylphenol-ethylene oxide adduct of about 71% by weight ethylene oxide; and (4) 25% by weight of a castor oil-ethylene oxide adduct of about 60% by weight ethylene oxide. Cleaning solution is normally added at about 1 part to 1 part sludge. The nonionic surfactant's concentration in the cleaning solution is, by volume, typically about 0.25% (2500 ppm), but it can range from 0.1% (1000 ppm) to 1.0% (10,000 ppm).

3. Add diluent as solvent for the recovered hydrocarbon (FIG. 2). The diluent can be diesel, heating oil, light cycle oil, or similar materials that are immiscible with the aqueous layer. The amount required depends upon the sludge characteristics and the ability of the diluent to accept, solubilize, and disperse the recovered hydrocarbon into a stable solution. In some cases, additional diluent is added to float the roof.

4. Heat tank contents to 145° F. to 180° F. to liquefy the hydrocarbon in the sludge. A preferred temperature is 150° F. During this step, the penetration and cleansing action of the chemical and water solution will allow clean hydrocarbon to rise through to the diluent while solids remain on the bottom. Water circulation is required in this step to distribute heat. The preferred circulation technique is to draw from and return to the aqueous layer (FIG. 3). Agitation of the diluent layer is unnecessary. The number of connections required depends upon the size of the tank. Heat may be supplied by an existing internal steam coil or heat exchanger. If a heating system is not available, a rental unit such as a diesel fired boiler may be used. A heat exchanger may also be rented or a spare obtained from the refinery. Sludge levels are monitored during heating; this can be done by conventional means. When the temperature is 145° F. to 180° F. and the floor is free of hydrocarbon sludge, the cleaning is complete (FIG. 4).

5. Pump the hydrocarbon directly to the crude unit before the temperature of the diluent layer, which contains the hydrocarbon, drops below its pour point. Fluid levels and pump configurations may require that some water be drained prior to this step. Survey the desalter operation before pumpout begins. Start at a low rate and increase as governed by crude unit operation. Desalter upsets can send excessive oil and solids to the waste water treatment plant (WWTP). Through careful monitoring of desalter operation and adjusting the charge rates accordingly, upsets which could effect WWTP performance can be prevented.

6. Drain water to the API separator. This is normally done via the water draw system. Water samples can be analyzed for TOC, NH3, COD, or other analysis desired to provide water quality information. Again, control of the draining rate will prevent downstream problems.

7. Residual solids can be removed by flushing them to one side of the tank with a fire hose and removing them with a vacuum truck.

The following two examples are illustrative and not intended to limit the scope of this invention's claims.

EXAMPLE 1

A 400,000 bbl crude storage tank contained five feet (35,900 bbl) of sludge. The sludge caused crude unit upsets by plugging the suction of the charge pumps and sending excessive solids to the unit, negatively impacting the desalter operation. The tank water draw line also plugged for a period of time preventing dewatering of the crude. Available storage capacity was reduced and the minimum tank level was increased from 5.7' (40,700 bbl) to 7.5' (53,500 bbl). The sludge was so hard that an 18 pound gaging bob could not penetrate it to reach the tank's bottom. A sludge sample indicated the tank contained 33,000 bbl of recoverable oil.

The refinery wanted the sludge removed to eliminate crude unit upsets, restore crude storage capacity, and regain the ability to accurately monitor crude deliveries to the tank. However, the cleaning had to be accomplished within a three week time frame due to the crude oil receipts schedule. A sludge sample was successfully tested in a 30" tank simulator under application conditions. Testing is recommended because if, for example, catalyst slurry has been stored in the tank, the technique may not be applicable.

The invention was then used on the oil storage tank. Existing circulation pumps and heat exchangers heated the tank to 150° F. The diluent was light cycle oil, supplied directly from a unit. The tank bottom was cleaned and the tank put back in service in 17 days. Only ⅛" (75 bbl) of solids were left on the bottom. The bottom was so clean that tank entry was not required. None of the original 6,300 tons of sludge had to be removed for disposal. The sludge was separated into clean oil, water, and oil-free solids. The water was drained to the API and through the WWTP. The 33,000 bbl of oil were recovered through the crude unit for a 99.9% oil recovery.

Economically, the refinery recovered $391,900 based on expenses of $103,100 and oil recovery of $495,000. Manual cleaning of a sludge quantity this large would have likely resulted in off-site disposal at $250/ton (6,300 tons × $250/ton = $1,575,000). Moreover, had the cleaning time exceeded the three week window, tanker demurrage could have been incurred.

EXAMPLE 2

A 320,000 bbl crude storage tank contained about three feet (25,500 bbl) of sludge. A sludge sample indicated the tank contained 24,500 bbl of recoverable oil. Two circulation pumps were used. One pump circulated the cleaning solution within the tank. A second pump was used to circulate the solution through a steam heated exchanger. The tank was heated to 150° F. at which time the floor was sludge-free. The invention recovered over 24,000 bbl of clean oil, which were processed through the crude unit. The value of the recovered oil at $15/bbl was $360,000. The water and spent chemical were pumped to the water treatment plant without problems. The overall oil recovery was 98.0%. The invention reduced both water and sediment content to a trace; it minimized waste to 60 bbl of heavy solids.

What is claimed is:

1. A process for separating and removing the hydrocarbon, water and solid components of sludge deposited in an oil storage tank which comprises:

(a) introducing a sufficient amount of a nonionic surfactant in an aqueous solution to form a layer of the solution above the sludge layer; said nonionic surfactant comprising: $C_8$–$C_{12}$ alkylphenol-ethylene oxide adducts of about 55%–75% by weight ethylene oxide, and at least one castor oil-ethylene oxide adduct of about 55%–75% by weight ethylene oxide; said nonionic surfactant being present in a quantity sufficient to separate hydrocarbon component from the sludge without forming an emulsion, (b) adding a diluent, immiscible with the aqueous layer, for extracting the hydrocarbons, and (c) separately draining the diluent layer and aqueous layer from the tank.

2. The process of claim 1, wherein the nonionic surfactant comprises:

(1) About 25% by weight of a nonylphenol-ethylene oxide adduct of about 68% by weight ethylene oxide, (2) About 25% by weight of a nonylphenol-ethylene oxide adduct of about 60% by weight ethylene oxide, (3) About 25% by weight of a nonylphenol-ethylene oxide adduct of about 71% by weight ethylene oxide, and (4) About 25% by weight of a castor oil-ethylene oxide adduct of about 60% by weight ethylene oxide.

3. The process of claim 1, wherein said nonionic surfactant comprises four of said adducts, each adduct present in the nonionic surfactant at about 10%–40% by weight.

4. The process of claim 1, wherein some or all of the castor oil adduct is replaced by a $C_8$–$C_{12}$ aliphatic ethylene oxide adduct.

5. The process of claim 1, wherein the diluent is diesel, heating oil, light cycle oil.

6. The process of claim 1, wherein the tank contents are heated to 145° F. to 180° F. by warming and circulating the aqueous layer of solution until the hydrocarbon and hydrophilic components of sludge are solubilized.

7. The process of claim 6, wherein heat is added to the tank by drawing aqueous solution out of the tank, through a heat exchanger, and back into the tank's aqueous layer.

8. The process of claim 1, further comprising pumping the diluent layer containing the recovered hydrocarbon directly into the crude unit.

9. The process of claim 1, further comprising removal of solids that remain after draining the diluent layer and aqueous layer.

10. A process for separating and removing the hydrocarbon, water and solid components of sludge deposited in an oil storage tank which comprises:

(a) introducing a sufficient amount of a nonionic surfactant in an aqueous solution without forming an emulsion to form a layer of the solution above the sludge layer; said nonionic surfactant comprising:

(1) About 25% by weight of a nonylphenol-ethylene oxide adduct of about 68% by weight ethylene oxide, (2) About 25% by weight of a nonylphenol-ethylene oxide adduct of about 60% by weight ethylene oxide, (3) About 25% by weight of a nonylphenol-ethylene oxide adduct of about 71% by weight ethylene oxide, (4) About 25% by weight of a castor oil-ethylene oxide adduct of about 60% by weight ethylene oxide; said nonionic surfactant being present in a quantity sufficient to separate the hydrocarbon component from the sludge, (b) adding a diluent, immiscible with the aqueous layer, for extracting the hydrocarbons, and (c) separately draining the diluent layer and aqueous layer from the tank.

11. The process of claim 10, wherein the diluent is diesel, heating oil, light cycle oil or other similar materials.

12. The process of claim 10, wherein the tank contents are heated to 145° F. to 180° F. by warming and circulating the aqueous layer of solution until the hydrocarbon and hydrophilic components of sludge are solubilized.

13. The process of claim 12, wherein heat is added to the tank by drawing aqueous solution out of the tank, through a heat exchanger, and back into the aqueous layer.

14. The process of claim 10, further comprising pumping the diluent layer containing the recovered hydrocarbon directly into the crude unit.

15. The process of claim 10, further comprising removal of solids that remain after draining the diluent layer and aqueous layer.

* * * * *